US008147179B2

(12) United States Patent
Bohrenkämper et al.

(10) Patent No.: US 8,147,179 B2
(45) Date of Patent: Apr. 3, 2012

(54) HOT-GAS-DUCTING HOUSING ELEMENT, PROTECTIVE SHAFT JACKET AND GAS TURBINE SYSTEM

(75) Inventors: Gerhard Bohrenkämper, Essen (DE); Milan Schmahl, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1119 days.

(21) Appl. No.: 11/988,709

(22) PCT Filed: Jul. 4, 2006

(86) PCT No.: PCT/EP2006/063825

§ 371 (c)(1),
(2), (4) Date: Jan. 11, 2008

(87) PCT Pub. No.: WO2007/006680

PCT Pub. Date: Jan. 18, 2007

(65) Prior Publication Data

US 2009/0035124 A1 Feb. 5, 2009

(30) Foreign Application Priority Data

Jul. 11, 2005 (EP) ..... 05015001

(51) Int. Cl.
*F01D 25/26* (2006.01)

(52) U.S. Cl. ..... 415/108; 415/116

(58) Field of Classification Search ..... 415/108, 415/185, 177

See application file for complete search history.

(56) References Cited

U.S. PATENT DOCUMENTS

| | | | | |
|---|---|---|---|---|
| 2,584,899 | A | 2/1952 | McLeod | |
| 4,465,284 | A * | 8/1984 | Szema | 277/628 |
| 4,497,610 | A | 2/1985 | Richardson et al. | |
| 5,081,833 | A | 1/1992 | Mezzedimi et al. | |
| 5,149,247 | A | 9/1992 | Gros et al. | |
| 6,286,317 | B1 | 9/2001 | Burrus et al. | |
| 6,751,962 | B1 * | 6/2004 | Kuwabara et al. | 60/800 |
| 2004/0261419 | A1 | 12/2004 | McCaffrey et al. | |

FOREIGN PATENT DOCUMENTS

| | | | |
|---|---|---|---|
| EP | 0 974 734 | A2 | 1/2000 |
| EP | 1 143 107 | A2 | 10/2001 |
| EP | 1 176 285 | A2 | 1/2002 |
| EP | 1 512 844 | A2 | 3/2005 |
| WO | WO 2004/046510 | A1 | 6/2004 |

* cited by examiner

*Primary Examiner* — Richard Edgar

(57) ABSTRACT

Disclosed is a hot-gas-conducting housing element for a hot-gas-conducting housing of a gas turbine system encompassing a compressor, a turbine, and a turbine rotor. The hot gas-conducting housing element is embodied so as to surround a protective shaft jacket placed around the turbine rotor and conduct a hot gas to the turbine. The hot gas-conducting housing element comprises: — at least one hot gas inlet; — an opening facing the turbine; — a section for conducting the hot gas from the at least one hot gas inlet to the opening facing the turbine, said conducting section being provided with an inner housing hub which is configured so as to surround the protective surface facing the protective shaft jacket. Said rib extends in the circumferential direction, protrudes from the circumferential surface, and is disposed in the zone of the circumferential surface bordering the opening that faces the turbine. The rib and/or the inner housing hub is/are fitted with cooling fluid ducts.

9 Claims, 5 Drawing Sheets

HOT-GAS-DUCTING HOUSING ELEMENT, PROTECTIVE SHAFT JACKET AND GAS TURBINE SYSTEM

CROSS REFERENCE TO RELATED APPLICATIONS

This application is the US National Stage of International Application No. PCT/EP2006/063825, filed Jul. 4, 2006 and claims the benefit thereof. The International Application claims the benefits of European application No. 05015001.0 filed Jul. 11, 2005, both of the applications are incorporated by reference herein in their entirety.

FIELD OF INVENTION

The present invention relates to a hot-gas-ducting housing element for a hot-gas-ducting housing, which element can be arranged particularly in a gas turbine system around a turbine rotor of the gas turbine system and serves to conduct a hot gas to a turbine part of the gas turbine system. The present invention relates further to a protective shaft jacket of the hot-gas-ducting housing, which jacket is embodied for surrounding the turbine rotor of the gas turbine system. The present invention relates finally to the hot-gas-ducting housing itself and to a gas turbine system having a hot-gas-ducting housing.

BACKGROUND OF THE INVENTION

A gas turbine system 1 essentially comprises one or more combustion chambers 3 (see FIG. 1) in which a fuel is burned, a turbine 5 to which the combustion exhaust gases that are hot and under pressure are ducted from the combustion chambers 3 and in which the exhaust gases perform work while cooling and expanding and thereby cause the turbine 5 to rotate, and a compressor 7 that is coupled to the turbine 5 via a shaft 15 and via which the air necessary for combustion is taken in and compressed to a higher pressure.

Hot-gas-conducting housings are employed in gas turbine systems for ducting the hot combustion exhaust gases. That applies particularly to gas turbine systems of the kind in which what are termed silo combustion chambers are used that are as a rule arranged on both sides of the turbine. FIG. 1 shows a schematic view of a gas turbine system of said type, with FIG. 1*a* showing a horizontal and FIG. 1*b* a vertical section through the system. The combustion exhaust gases 2 flow out of said silo combustion chambers 3 in a direction substantially perpendicular to the rotational axis A of the turbine 5. Arranged between the outlet 18 of the silo combustion chambers and the turbine 5 is a mixer housing 8 to which on the turbine side is joined an inner housing 9 located inside the gas turbine housing 2. The function of the inner housing 9 is to protect the surrounding components from heat and redirect the hot gases exiting the mixer housing 8 toward the turbine. On exiting the inner housing 9, which means on entering the turbine 5 of the gas turbine system 1, the combustion exhaust gases then flow substantially parallel to the rotational axis A of the turbine shaft 12.

Hot-gas-conducting housings, and in particular the described inner housings in gas turbine systems having silo combustion chambers, are thermally highly stressed components. For that reason measures are taken to cool the hot-gas-ducting surfaces of the housing. Said measures include cooling the regions particularly under stress by means of a cooling fluid that flows along the outer side of the walls of said regions in order to absorb and remove the heat transferred to the hot-gas-ducting surfaces.

An inner housing 9, as previously described, has as a rule a hot-gas-ducting housing element 100 having an inner housing hub 101. The inner housing hub 101 surrounds a protective shaft jacket 115 (FIG. 7*a*) which in turn surrounds the shaft 12. The surface 109 of the inner housing hub 101 facing the housing interior therein forms the guiding and conducting surface for the combustion exhaust gases 2, while the surface 104 of the inner housing hub 101 facing away from the housing interior surrounds the protective shaft jacket 115. The inner housing hub 101 is fixed in position on the protective shaft jacket 115 by means of an annular rib 103 arranged centrally in the axial direction and projecting toward the protective shaft jacket 115. The protective shaft jacket 115 itself is secured to the gas turbine housing 2 and has a stud 105 in which is located an annular groove 106 into which the annular rib 103 engages. The inner housing hub 101 and protective shaft jacket 115 are mounted in the gas turbine system jointly as a unit.

To enable a cooling fluid F to flow from one side of the rib 103 or, as the case may be, of the stud 105 to the other, the stud 105 has passage openings 107 through which the cooling fluid can flow (see FIGS. 7*a* and 7*b*).

When the hot-gas-ducting housing is operating, the rib 103 is, however, heated less than the material regions closer to the hot-gas-ducting surface 109 of the cylindrical inner housing hub 101. This results in what is termed a ferrule effect that gives rise to tensions in the material regions of the inner housing hub 101 that border the rib 103. Cracks can therefore occur in the material particularly at the locations indicated by the reference numerals 111.

To reduce the risk of a defect due to cracking, the maximum number of starts, meaning the number of starts of the gas turbine system after which an inspection for cracking or a repair is to be performed, is generally limited. Furthermore the rib was relocated to the region of the inner housing's opening on the turbine side so as to be located in a thermally less stressed region of the inner housing.

SUMMARY OF INVENTION

Compared with said prior art an object of the present invention is to provide an improved hot-gas-ducting housing element for a hot-gas-ducting housing of a gas turbine system, in which element the risk of cracking is reduced and the number of starts before an inspection or repair can be increased.

A further object of the present invention is to provide a protective shaft jacket for a hot-gas-ducting housing of a gas turbine system, which jacket will enable a hot-gas-ducting housing element to be better fixed in position.

Yet a further object of the present invention is to provide an improved housing unit for a gas turbine system.

It is finally an object of the present invention to provide an improved gas turbine system.

The first object is achieved by means of a hot-gas-ducting housing element as claimed, the second object is achieved by means of protective shaft jacket as claimed in, the third object is achieved by means of a housing unit as claimed, and the fourth object is achieved by means of a gas turbine system as claimed. The dependent claims contain advantageous embodiments of the invention.

An inventive hot-gas-ducting housing element for a hot-gas-ducting housing of a gas turbine system having a compressor, a turbine and a turbine rotor is embodied for surrounding a protective shaft jacket requiring to be arranged around the turbine rotor and for ducting a hot gas to the turbine. Said element includes at least one hot gas inlet orifice, an opening on the turbine side, and a ducting section for ducting the hot gas from the at least one hot gas inlet orifice to the opening on the turbine side. The ducting section has an inner housing hub that is embodied for surrounding the protective shaft jacket of the gas turbine system and which extends up to the opening on the turbine side and has on a circumferential surface requiring to be arranged facing the protective shaft jacket a rib that extends entirely or partially in the circumferential direction along the circumferential surface and projects beyond it. The inner housing hub can be at least approximately cylindrical in form and have the shape in particular of a hollow cylinder, with the circumferential surface requiring to be arranged facing the protective shaft jacket then constituting the inner surface of the hollow cylinder. A rib is arranged in the region of the circumferential surface bordering the opening on the turbine side. In the inventive hot-gas-ducting housing element, the rib is provided with cooling fluid channels. The inner housing hub is additionally or alternatively provided with cooling fluid channels at least in the region of the rib.

Arranging the rib in the region of the inner housing hub's circumferential surface bordering the opening on the turbine side will enable a cooling fluid to flow largely unimpeded along the inner housing hub up to the opening on the turbine side, which alone will improve the possibilities for cooling the inner housing hub. As a result of the inventive arrangement of the cooling fluid channels it is now also possible to improve the cooling possibility in the rib region by reducing the barrier effect of the rib or improving the ducting of the cooling fluid in the region of the rib.

The barrier effect on the flow of the cooling fluid can be reduced if the rib is provided with cooling fluid channels enabling the cooling fluid to pass through the rib. The flow of the cooling fluid will therein be especially little impeded if said cooling fluid channels are arranged in the rib such that they run close to the circumferential surface of the inner housing hub virtually parallel to its axial direction.

The cooling effect can also be improved if the inner housing hub is provided with cooling fluid channels. They can each have, for example, an opening on the protective shaft jacket side, meaning an opening in the circumferential surface requiring to be arranged facing the protective shaft jacket, and an opening on the hot gas side, meaning an opening in the surface ducting the hot gas. In particular a cooling fluid film can form on the surface, on the hot gas side, of the inner housing hub if, over their course through the inner housing hub as viewed from the opening on the protective shaft jacket side constituting an inlet orifice for the cooling fluid, the cooling fluid channels have an inclination in the flow direction of the hot gas requiring to be ducted.

Additionally or alternatively to the cooling fluid channels provided with openings on the protective shaft jacket side and hot gas side there can also be cooling fluid channels running parallel to the hot-gas-ducting surface of the inner housing hub between an inlet orifice for the cooling fluid to enter and an outlet orifice for the cooling fluid to exit. Cooling fluid channels of said type will enable particularly effective cooling of the inner housing hub.

A hot-gas-ducting surface and in particular the inner housing hub can be provided with a thermally insulating and/or corrosion-inhibiting and/or oxidation-inhibiting coating in order to minimize wear and tear in the hot-gas-ducting housing.

An inventive protective shaft jacket for a gas turbine system having a compressor, a turbine and a turbine rotor is embodied for surrounding the turbine rotor in the region between the compressor and the turbine of the gas turbine system and has a depression extending in the circumferential direction entirely or partially over its circumference for accommodating a rib of a hot-gas-ducting housing element, of the hot-gas-ducting housing, requiring to be arranged around the protective shaft jacket. In the inventive protective shaft jacket the depression is located in a stud that projects radially beyond the circumferential surface and is completely closed, which is to say has no cooling fluid channels.

A hot-gas-ducting housing element can be fixed in position by inserting the rib into the depression of the protective shaft jacket. The stud can therein function as, for example, a spacer between the protective shaft jacket and inner housing hub of a hot-gas-ducting housing element so that a space through which a cooling fluid can flow will remain between the inner housing hub and protective shaft jacket.

An inventive housing unit includes a hot-gas-ducting housing having an inventive hot-gas-ducting housing element as well as an inventive protective shaft jacket. The hot-gas-ducting housing can therein be embodied particularly as an inner housing for a gas turbine system having at least one silo combustion chamber.

An inventive gas turbine system includes at least one combustion chamber, a turbine part and an inventive hot-gas-ducting housing arranged between the at least one combustion chamber and the turbine part for ducting the hot gas originating from the at least one combustion chamber to the turbine part. The inventive gas turbine system can in particular include at least one silo combustion chamber and a mixer housing arranged between the silo combustion chamber and hot-gas-ducting housing. The hot-gas-ducting housing will then be embodied as an inner housing of the gas turbine system.

BRIEF DESCRIPTION OF THE DRAWINGS

Further features, characteristics and advantages of the present invention will emerge from the following description of exemplary embodiments with reference to the attached figures.

DETAILED DESCRIPTION OF INVENTION

Figure 1A:
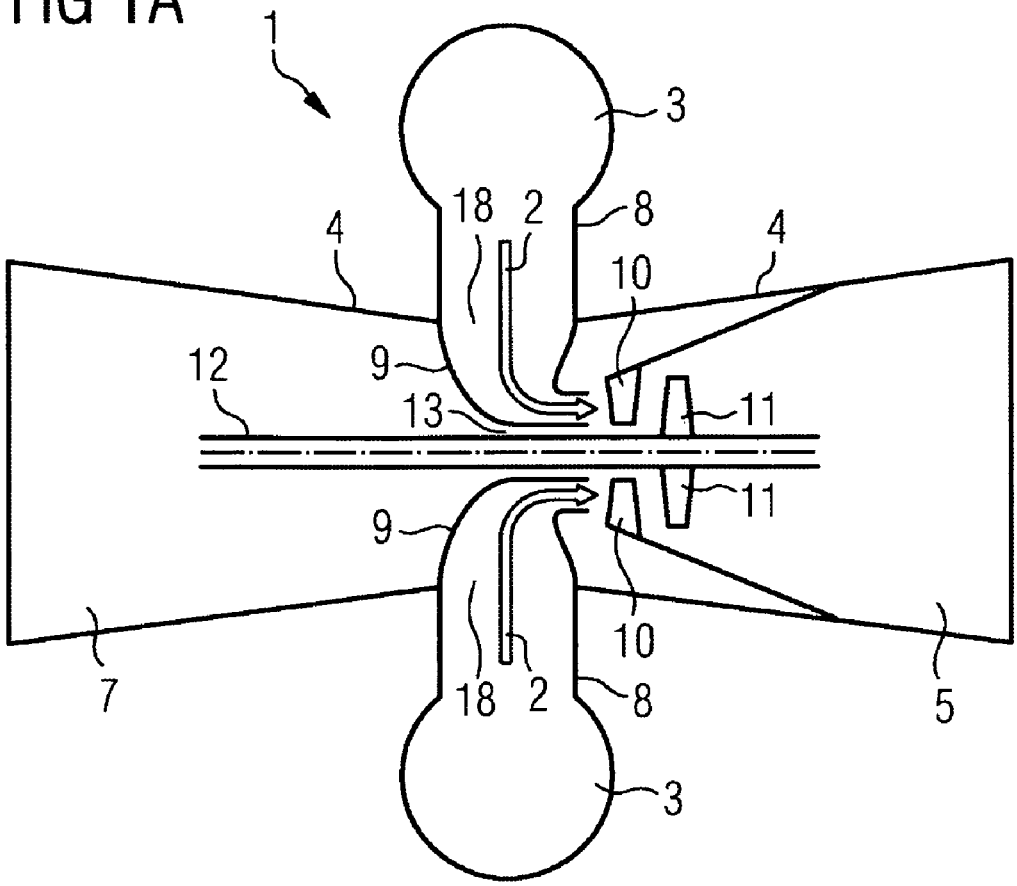
FIG. 1*a* shows in a highly schematic form a horizontal section through a gas turbine system having two silo combustion chambers.
Figure 1B:
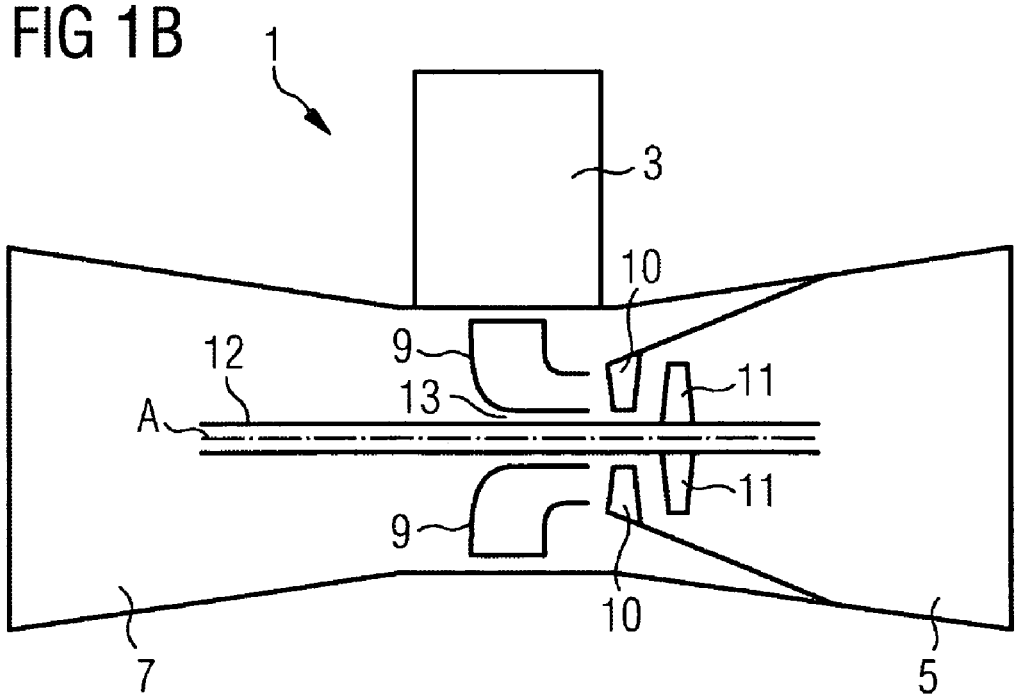
FIG. 1*b* shows in a highly schematic form a vertical section through the gas turbine system shown in FIG. 1*a*.

An example of a gas turbine system 1 is shown in FIGS. 1*a* and 1*b* in a highly schematic form. The gas turbine system 1 includes two silo combustion chambers 3, a turbine 5, a compressor 7, two mixer housings 8, and an inner housing 9. The silo combustion chambers 3 serve to burn a fuel, with the hot, pressurized exhaust gases 2 being ducted via the mixer housings 8 and inner housing 9 to the turbine 7 in order to drive it.

The turbine 5 includes stationary guide vanes 10 as well as rotor blades 11 permanently connected to a shaft 12 mounted rotatably around an axis A. The hot exhaust gas 2 expanding in the turbine 5 causes an impulse to be conveyed via the rotor blades 11 to the shaft 12, which is thereby made to rotate.

The shaft 12 can be roughly divided into three sections, namely a section bearing the rotor blades 11 of the turbine 5, a section bearing rotor blades of the compressor 7 (not shown), and a shaft section 13 that is arranged between said two sections and in which no rotor blades are disposed. The shaft 12 and the rotor blades 11 attached thereto form what is termed the turbine rotor.

The shaft 12 extends through the entire gas turbine system (not shown in full) and drives the compressor 7 as well as a generator (not shown). The compressor 7 therein serves to compress air that is then ducted to the silo combustion chambers 3 for the combustion.

The shaft section 13 is surrounded by a protective shaft jacket 15 (see FIG. 2) which is itself surrounded by an inner housing hub 17 of a hot-gas-ducting housing element 6 of the inner housing 9. The inner housing 9 and protective shaft jacket 15 are installed in the gas turbine system together as a housing unit.

The inner housing hub 17 and protective shaft jacket 15 are shaped substantially like a hollow cylinder, with the circumferential surface 14, facing the protective shaft jacket 15, of the inner housing hub 17 or, as the case may be, the surface, facing the turbine rotor, of the protective shaft jacket 15 forming the inner surfaces of the hollow cylinder.

The inner housing 9 therein serves on the one hand to divert the hot exhaust gas flowing from the mixer housings 8 into the inner housing 9 and, on the other, to distribute it as evenly as possible around the entire circumference of the turbine rotor. The surface 20, facing the hot gas, of the inner housing 9 therein serves as a guiding and conducting surface for the hot gas. Said surface can in particular also be provided with a thermally insulating coating or a corrosion- and/or oxidation-inhibiting coating. Potential candidates for a thermally insulating coating are, for example, what are termed thermal barrier coatings, TBC for short, which can be produced from, say, yttrium-stabilized zirconium oxide. Potential candidates for corrosion- and/or oxidation-inhibiting coatings are, for example, what are termed MCrAlY coatings, where M stands for iron (Fe), cobalt (Co), or nickel (Ni), and Y stands for yttrium (Y) and/or silicon and/or a rare-earth element, for example hafnium (Hf). Alloys of said type are known from, inter alia, the following documents, to which reference is made with respect to suitable MCrAlY coatings: EP 0 486 489 B1, EP 0 786 017 B1, EP 0 412 397 B1, and EP 1 306 454 A1. The thermal barrier coating TBC can therein have been applied in particular to the MCrAlY coating.

Figure 2:
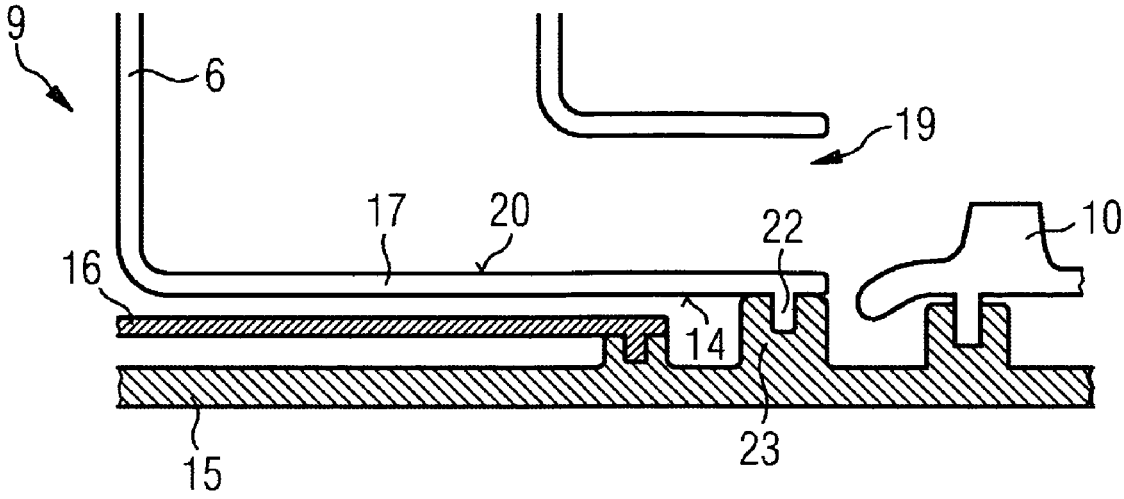
FIG. 2 shows a section of an inventive gas turbine system in which can be seen parts of an inner housing.

FIG. 2 shows a section that has been taken from FIG. 1*b* and in which can be seen the inner housing hub 17 of the inner housing 9 and a part of the protective shaft jacket 15. Also to be seen is a section of a guide vane 10 of the turbine 5 located opposite the opening 19, on the turbine side, of the inner housing 9.

The inner housing hub 17 of the inner housing 9 has in the region of the opening 19 on the turbine side an annular rib 22 that projects radially toward the protective shaft jacket 15 and extends along its entire circumference.

The protective shaft jacket 15 includes an annular stud 23 that extends in the region of the outlet orifice 19 of the inner housing 9 along the entire circumference of the protective shaft jacket 15. The stud 23 has a groove 26 serving to accommodate the rib 22 of the inner housing hub 17. The inner housing hub 17 of the hot-gas-ducting housing element 6 can be fixed in position on the protective shaft jacket 15 by means of the rib 22 and the groove 26 in the stud 23.

The protective shaft jacket 15 further has a radiation guard 16 that surrounds it spaced therefrom. A flow channel is in that way formed between the radiation guard 16 and protective shaft jacket 15. A further flow channel is formed between the radiation guard 16 and the inner housing hub 17 of the hot-gas-ducting housing element 6. The radiation guard 16 has passage openings 21 for the passage of cooling fluid toward the inner housing hub 17 which serve to duct a cooling fluid F, for example ambient air, into the flow channel between the radiation guard 16 and inner housing hub 17 (see FIG. 3). The cooling fluid passing through the openings 21 is used for impingement cooling of the inner housing hub 17 and is forwarded to the turbine 5 via the flow channel 24 formed between the radiation guard 16 and inner housing hub 17, with the inner housing hub 17 being additionally convectively cooled. What is therein to be understood by the term "impingement cooling" is the ducting of cooling fluid flowing in a direction of said type such that it will impact against the surface 14, on the hub side, of the inner housing hub 17 and be diverted by it.

To make the invention easier to understand, an inner housing 9 according to the prior art in which the rib of the hot-gas-ducting housing element 6 is located in the region of the opening, on the turbine side, of the inner housing 9 will first be described with reference to FIG. 3. Inner housings 9 exhibiting three different embodiment variants of the inventive hot-gas-ducting housing element 6 will then be described with reference to FIGS. 4 to 6. The prior art and all embodiment variants have an inner housing hub 17, 17*a*, 17*b*, 17*c* in each case provided in the region of the opening on the turbine side with a rib 22, 22*a*, 22*b*, 22*c* projecting beyond the circumferential surface 14, 14*a*, 14*b*, 14*c* on the protective shaft jacket side.

Figure 3:
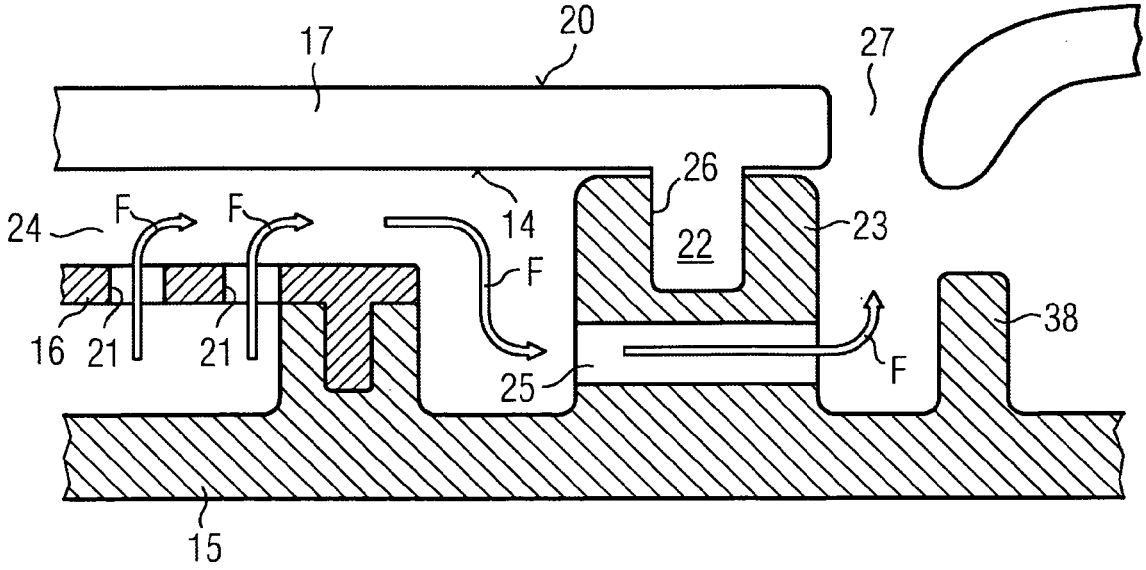
FIG. 3 shows in detail a section of an inner housing according to the prior art.

One embodiment of the inner housing hub 17, radiation guard 16 and protective shaft jacket 15 in the region of the rib 22 and of the stud 23 according to the prior art is shown in FIG. 3. In the prior art there are passage openings 25 shaped like drilled holes in the stud 23 below the groove 26 that enable the cooling fluid (indicated by arrows) to pass through the stud 23. Arranged on the protective shaft jacket 15 opposite the outlet end of the passage hole 25 in the flow direction is a guide rib 38 that causes the flow of cooling fluid to be redirected toward the hot exhaust gas flowing through the gas turbine system.

Figure 4:
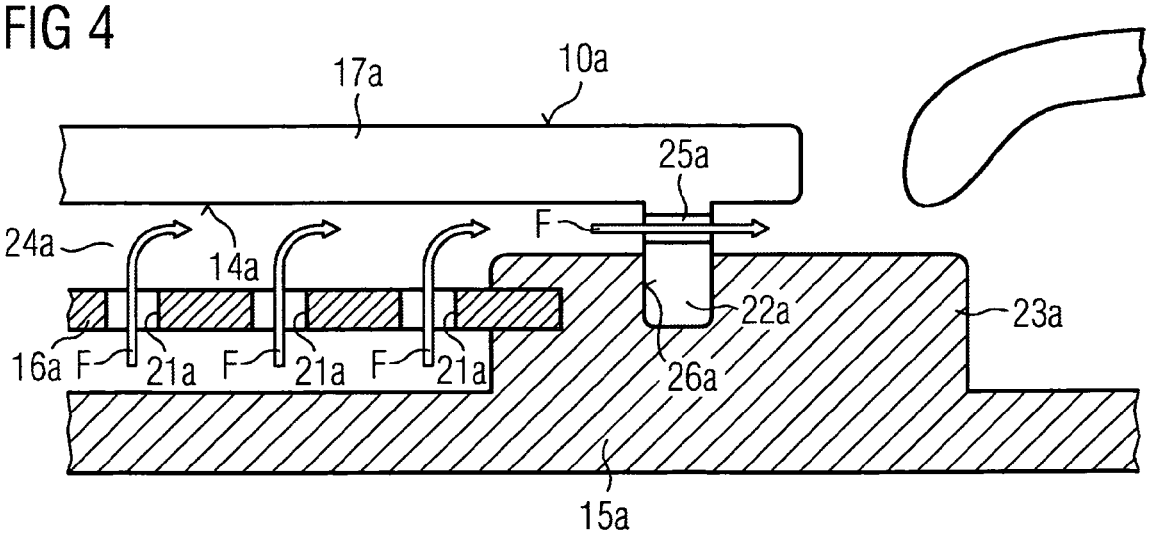
FIG. 4 shows in detail a first embodiment of the invention.

A first embodiment variant of the hot-gas-ducting housing element 6 is shown in FIG. 4. The figure shows the inner housing hub 17*a* of the radiation guard 16*a* as well as the protective shaft jacket 15*a* in the region of the stud 23*a*. The stud 23*a* of the protective shaft jacket 15*a* shown in FIG. 4 differs from the stud 23 of the protective shaft jacket 15 shown in FIG. 3 in being embodied wider and not projecting so far beyond the surface 20*a* of the protective shaft jacket 15*a*. Nor does it have a passage hole for the passage of a cooling fluid. A passage opening in the form of a drilled hole 25*a* enabling the cooling fluid to pass through the rib 22*a* is instead arranged in the rib 22*a* of the inner housing hub 17*a*. The passage hole is arranged in the immediate vicinity of the circumferential surface 14*a*, of the inner housing hub 17*a*, facing the protective shaft jacket 15*a*. Corresponding passage holes are distributed spaced apart in the circumferential direction over the entire annular rib 22*a*.

Figure 5:
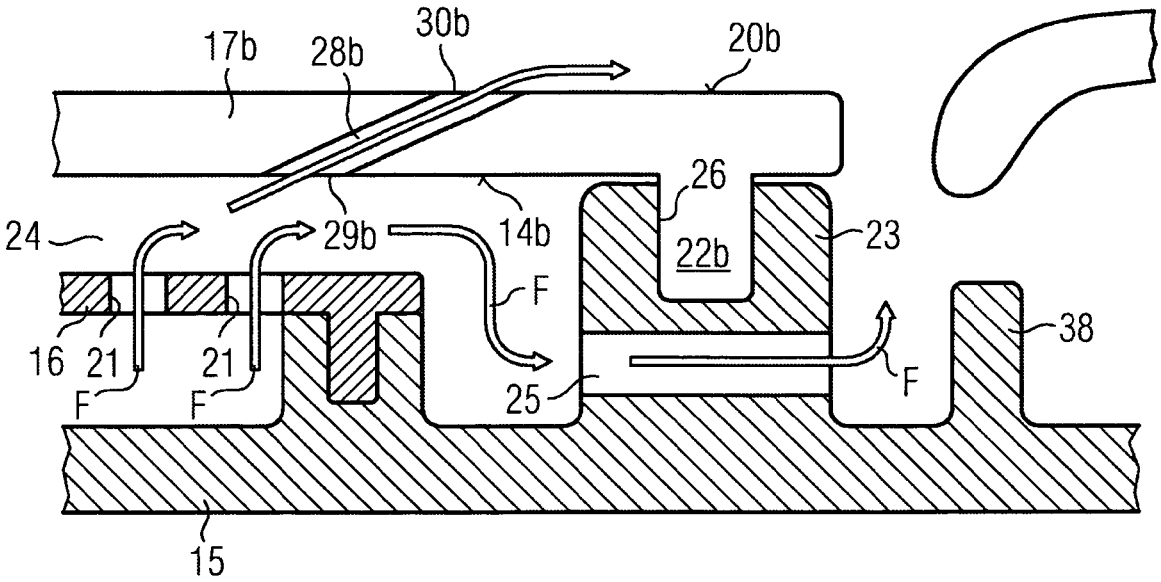
FIG. 5 shows in detail a second embodiment of the invention.

A second embodiment variant for embodying the hot-gas-ducting housing element 6 is shown in FIG. 5. The figure shows the inner housing hub 17*b*, the radiation guard 16 and the protective shaft jacket 15 in the region of the stud 23. The embodiment of the protective shaft jacket 15 and radiation guard 16 is the same as that of the corresponding parts in the embodiment described with reference to FIG. 3. However, in contrast to the inner housing hub 17 shown in FIG. 3 the inner housing hub 17*b* in the second embodiment variant has passage openings in the form of passage holes 28 having openings 29 on the protective shaft jacket side and openings 30 on the hot gas side. Compared to the openings 29 on the protective shaft jacket side the openings 30 on the hot gas side are therein displaced in the flow direction of the hot gas. In other words, as viewed from the circumferential surface 14*b* on the protective shaft jacket side the openings 29 have an inclination in the flow direction of the hot exhaust gases.

Through the passage holes 28, cooling fluid proceeding from the flow channel 24 enters the region of the inner housing 9 ducting the hot exhaust gas and owing to the flow conditions there prevailing forms a cooling fluid film across the surface 20*b*, of the inner housing hub 17*b*, on the hot gas side, in particular in the region of the rib 22*b*. That embodiment of the inner housing hub 17*b* will enable the surface 20*b* to be cooled very effectively.

Figure 6:
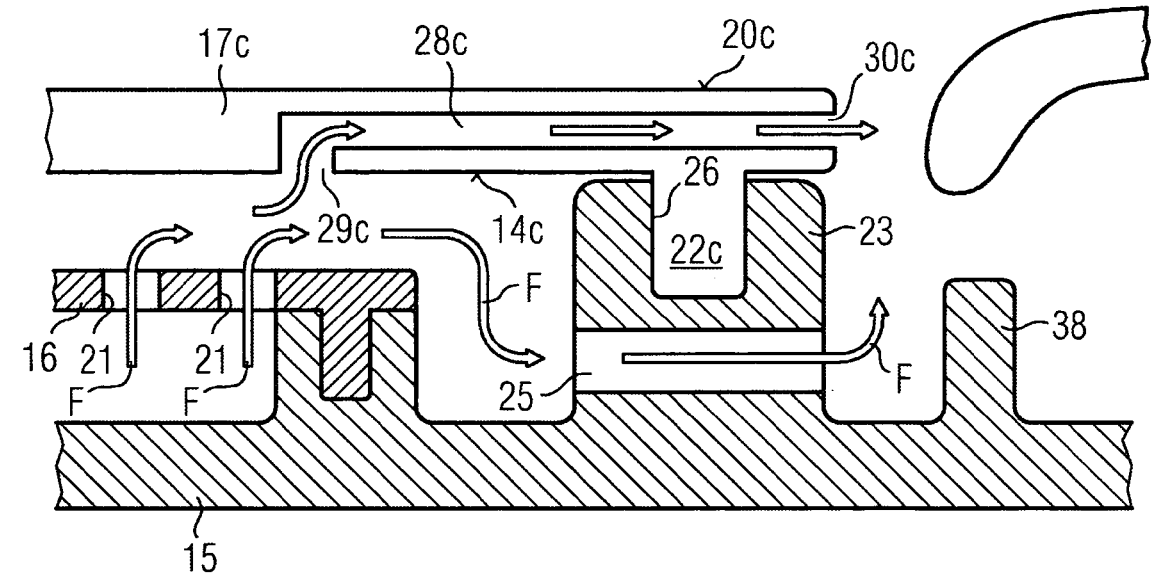
FIG. 6 shows in detail a third embodiment of the invention.
Figure 7A:
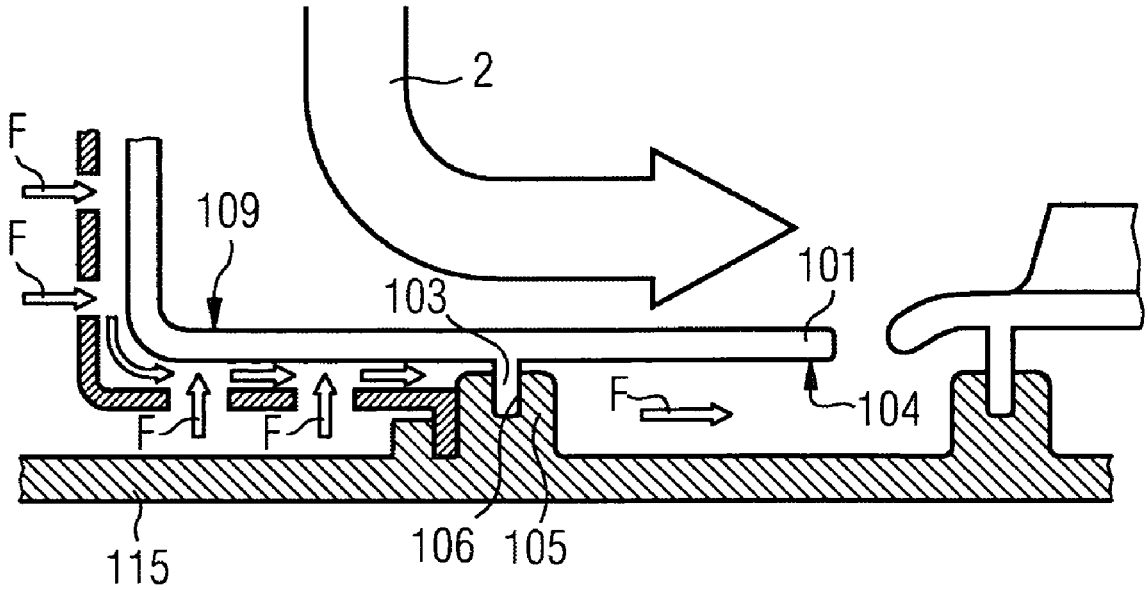
FIG. 7*a* shows a section of a gas turbine system according to the prior art in which can be seen parts of the inner housing.
Figure 7B:
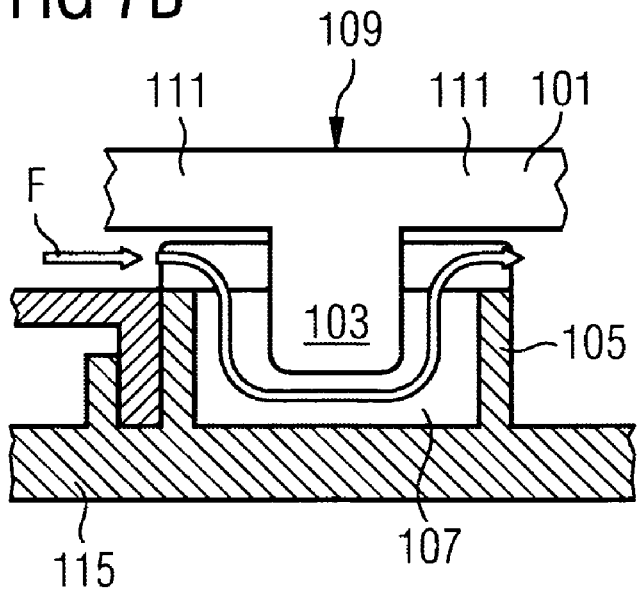
FIG. 7*b* shows in enlarged form a detail from FIG. 7*a*.

A third embodiment of the hot-gas-ducting housing element 6 is shown in FIG. 6. The figure shows the inner housing hub 17*c*, the radiation guard 16 and the protective shaft jacket 15 in the region of the stud 23. As in FIG. 5, the inner housing hub 17*c* has passage openings in the form of drilled holes 28*c*. Said drilled holes 28*c* each have an opening 29*c* on the protective shaft jacket side and an opening 30*c* located in the front side of the inner housing hub 17*c*. Between the opening 29*c* on the protective shaft jacket side and the opening 30*c* on the front side, each passage hole 28*c* runs mostly parallel to the hot-gas-ducting surface 20*c* of the inner housing hub 17*c*.

Cooling fluid F entering through the opening 29*c* on the protective shaft jacket side is guided in the region of the rib 22*c* by means of the drilled holes 28*c* through the interior of the inner housing hub 17*c* and thereby causes cooling of the inner housing hub 17*c* before exiting from the opening 30*c* on the front side.

In the embodiment variants described with reference to FIGS. 5 and 6, the stud of the protective shaft jacket is in each case provided with passage openings for the passage of cooling fluid. Openings can alternatively also be provided in the rib, as has been described with reference to FIG. 4.

The invention claimed is:

1. An inner housing for a gas turbine system having a compressor, two silo combustion chambers, a turbine and a turbine rotor where inner housing is arranging between the silo combustion chambers and the turbine, comprising:

two hot gas inlet orifices for receiving the hot combustion exhaust gases of the silo combustion chambers;

an opening on the turbine side; and a hot-gas-ducting housing element constructed and arranged to surround a protective shaft jacket arranged around the turbine rotor in a region between the compressor and the turbine including a ducting section for ducting the hot gas from the hot gas inlet orifices to the opening on the turbine side where the ducting section has an inner housing hub that surrounds the protective shaft jacket extends up to the opening on the turbine side and has a rib arranged on a circumferential surface, where the rib is arranged facing the protective shaft jacket, extends in the circumferential direction, projects beyond the circumferential surface, and in the region of the circumferential surface bordering the opening on the turbine side, wherein the rib and/or the inner housing hub are/is provided with cooling fluid channels.

2. The inner housing as claimed in claim 1, wherein the cooling fluid channels extend through the rib and are arranged in the rib such that they run close to the circumferential surface of the inner housing hub parallel to the axial direction of the inner housing hub.

3. The inner housing as claimed in claim 2, wherein the cooling fluid channels extend through the inner housing hub and are each provided with an opening on the protective shaft jacket side and an opening on the hot gas side.

4. The inner housing as claimed in claim 3, wherein the cooling fluid channels have, over their course through the inner housing hub as viewed from the opening on the protective shaft jacket side, an inclination in the flow direction of the hot gas requiring to be ducted.

5. The inner housing as claimed in claim 1, wherein cooling fluid channels are provided in the inner housing hub that run parallel to a hot-gas-ducting surface of the inner housing hub between an inlet orifice for a cooling fluid to enter and an outlet orifice for a cooling fluid to exit.

6. The inner housing as claimed in claim 5, wherein the inner housing hub is essentially cylindrical.

7. The inner housing as claimed in claim 6, wherein the inner housing hub includes a hot-gas-ducting surface provided with a thermally insulating and/or corrosion-inhibiting and/or oxidation-inhibiting coating.

8. A protective shaft jacket for a gas turbine system having a compressor, a turbine and a turbine rotor where the shaft jacket, comprising:

a shaft jacket that surrounds the turbine rotor and arranged in a region between the compressor and the turbine and has a depression, extending in the circumferential direction, that accommodates a rib of a hot-gas-ducting housing element arranged around the protective shaft jacket of an inner housing; and a stud that projects radially beyond a circumferential surface and is completely closed and the stud is located in a section of the protective shaft jacket that is arranged adjacent to the turbine.

9. A gas turbine system, comprising:

a turbine rotor arranged along a rotational axis of the gas turbine;

two silo combustion chambers;

a compressor section a turbine section;

a housing unit arranged between the two silo combustion chambers having:

a shaft jacket that surrounds the turbine rotor and arranged in a region between the compressor and the turbine sections and has a depression, extending in the circumferential direction, that accommodates a rib of a hot-gas-ducting housing element arranged around the protective shaft jacket of an inner housing; and a stud that projects radially beyond a circumferential surface and is completely closed and the stud is located in a section of the protective shaft jacket that is arranged adjacent to the turbine.

* * * * *